US006332849B1

(12) United States Patent
Beasley

(10) Patent No.: US 6,332,849 B1
(45) Date of Patent: Dec. 25, 2001

(54) GOLF CLUB DRIVER WITH GEL SUPPORT OF FACE WALL

(75) Inventor: David E. Beasley, Littleton, CO (US)

(73) Assignees: Pyramid Products, Inc, Littleton, CO (US); Airways Associates, Matawan, NJ (US)

( * ) Notice: Subject to any disclaimer, the term of this patent is extended or adjusted under 35 U.S.C. 154(b) by 0 days.

(21) Appl. No.: 09/231,446

(22) Filed: Jan. 14, 1999

(51) Int. Cl.[7] ..... A63B 53/04
(52) U.S. Cl. ..... 473/332; 473/333; 473/346
(58) Field of Search ..... 473/345, 346, 473/324, 329, 332, 349, 336, 337, 333

(56) References Cited

U.S. PATENT DOCUMENTS 3,567,228 * 3/1971 Lynn .
3,817,522 * 6/1974 Simmons .
4,535,990 * 8/1985 Yamada .
4,811,949 * 3/1989 Kobayashi .
4,944,515 * 7/1990 Shearer .
5,082,279 * 1/1992 Hull .
5,088,734 * 2/1992 Glava .
5,263,713 * 11/1993 Taylor .
5,290,036 * 3/1994 Fenton .
5,464,211 * 11/1995 Atkins .
5,586,948 * 12/1996 Mick .
5,628,697 * 5/1997 Gamble .
5,756,195 * 5/1998 Allen .
5,797,807 * 8/1998 Moore .

* cited by examiner

*Primary Examiner*—Sebastiano Passaniti
(74) *Attorney, Agent, or Firm*—Arnold D. Litt

(57) ABSTRACT

A golf club head is disclosed. The golf club head includes a body having a front face, a rear face, a top and a bottom. The club head also includes a viscoelastic member positioned within the body and in direct contact with the front face of the body. The viscoelastic member counters force applied to the front face of the body when a golf ball is struck.

12 Claims, 2 Drawing Sheets

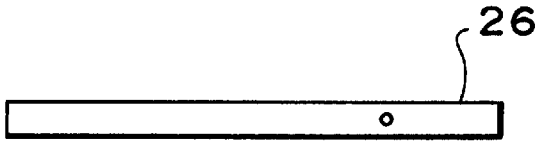
FIG. 3
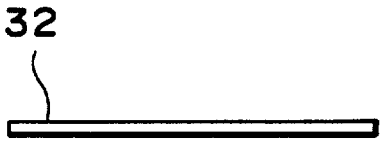
FIG. 4
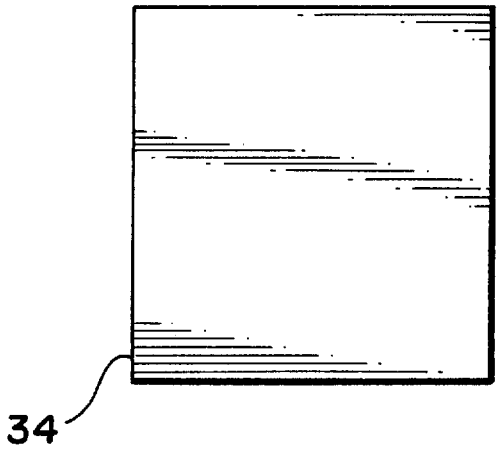
FIG. 5
FIG. 6
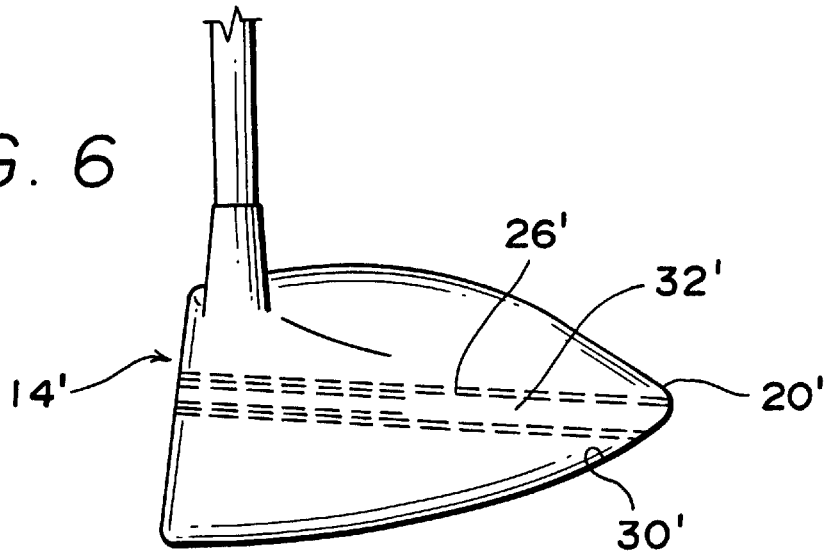

GOLF CLUB DRIVER WITH GEL SUPPORT OF FACE WALL

BACKGROUND OF THE INVENTION

1. Field of the Invention

The invention relates to a "metal wood" type golf club. More particularly, the invention relates to a metal wood golf club head employing a gel to improve the striking characteristics of the club head.

2. Description of the Prior Art

"Metal wood" type golf clubs have become the standard throughout the golf industry. Metal wood heads are generally made from metal castings, and have adopted the general golf club head shape employed in prior wood type golf club heads. The castings employed in metal wood heads commonly include a hollow interior and are formed to provide a single piece head.

While metal woods are highly successful, and have improved the golf games of both professionals and novices, metal woods still retain several problems which have not yet been dealt with in a desirable manner. Specifically, metal woods tend to transmit undesirable impact caused vibrations from the golf club head to the club shaft upon impact. In addition, metal woods are highly sensitive to the position a ball is struck on the front face. Unless a user strikes the ball directly in the sweet spot of a metal wood, the dynamic properties of the club head are altered, reducing the clubs efficiency and the ball's travel distance.

When a golfer strikes a golf ball with a hollow metal wood, the striking surface of the club head deflects elastically upon impact. The striking surface then rebounds as the ball is directed into play. The nature and direction of the rebound depend upon the location of the point of impact on the striking surface, and may affect the speed, rotation, and trajectory of the golf ball. Various attempts have been made in the prior art to alter the striking characteristics of metal woods. For example, some prior art golf club heads have included highly rigid striking surfaces, while other prior art golf club heads have provided highly elastic striking surfaces.

Although great strides have been made in the development of metal woods, a need continues to exist for improved metal woods. The present invention provides an improved metal wood.

SUMMARY OF THE INVENTION

It is, therefore, an object of the present invention to provide a striking implement including a body having a front face and a rear face. The implement further including a support tube extending from the front face of the body and a viscoelastic member positioned within the support tube. The viscoelastic member is in direct contact with the front face of the body and counters force applied to the front face of the head body when an object is struck by the striking implement.

It is also an object of the present invention to provide a golf club head including a body having a front face, a rear face, a top and a bottom. The club head includes a viscoelastic member positioned within the body and in direct contact with the front face of the body. The viscoelastic member counters force applied to the front face of the body when a golf ball is struck.

It is another object of the present invention to provide a golf club head wherein the viscoelastic member is an oil gel.

It is a further object of the present invention to provide a golf club head wherein the viscoelastic member directly contacts the rear face of the body.

It is a further object of the present invention to provide a golf club head wherein the interior of the support tube and the viscoelastic member are exposed though an opening in the rear face of the body.

It is also an object of the present invention to provide a golf club head including a support tube extending from the front face of the body, wherein the viscoelastic member being housed within the support tube.

It is another object of the present invention to provide a golf club head wherein the support tube includes a longitudinal axis which is substantially perpendicular to the front face.

It is a further object of the present invention to provide a golf club head wherein the viscoelastic member directly contacts the rear face of the body.

It is also an object of the present invention to provide a golf club head wherein the viscoelastic member includes a longitudinal axis which is substantially perpendicular to the front face.

It is another object of the present invention to provide a golf club head a golf club with the club head discussed above.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 3 is a side view of the support tube.

FIG. 4 is a side view of the gel member.

FIG. 5 is a top view of the cellulose wrap.

FIG. 6 is a cross sectional view of further embodiment of the present invention with the gel member open through the rear face of the golf club head.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
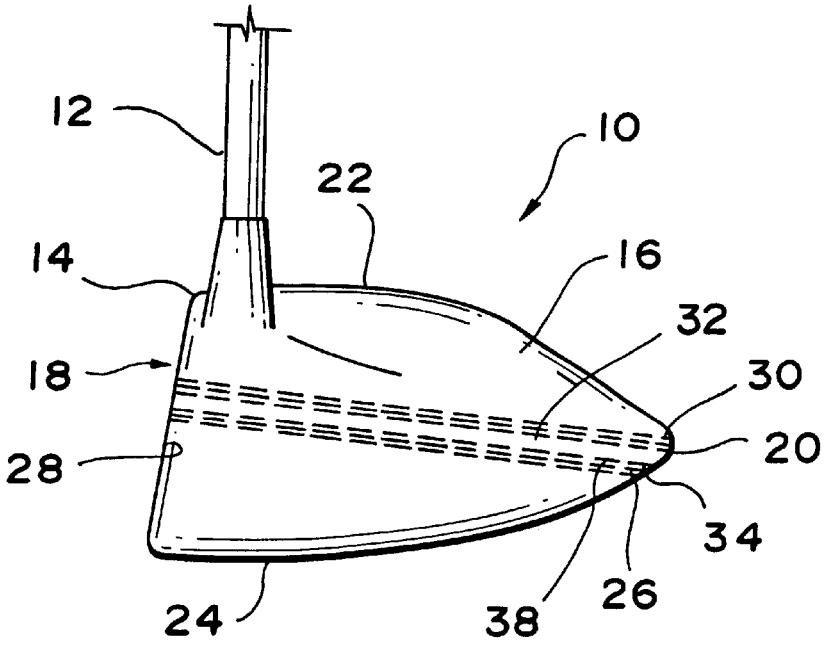
FIG. 1 is a side view of a golf club in accordance with the present invention.
Figure 2:
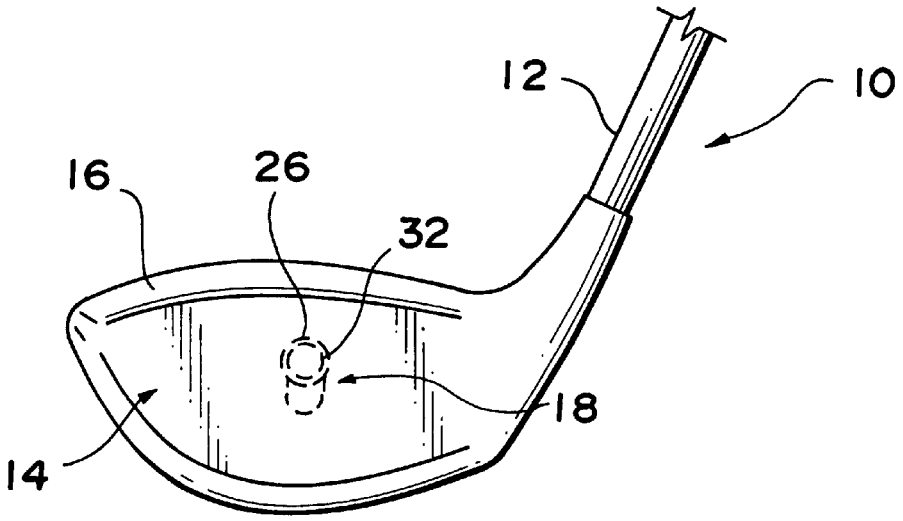
FIG. 2 is a front view of a golf club in accordance with the present invention.

With reference to FIGS. 1–5, a golf club 10 in accordance with the present invention is disclosed. The golf club 10 includes a golf club shaft 12 secured to a golf club head 14. The shaft 12 is a conventional shaft and may be manufactured from steel, graphite, fiber composites, or any other material those of ordinary skill in the art may consider appropriate for use as a golf club shaft.

The golf club head 14 includes a substantially hollow body 16 having a front face 18, a rear face 20, a top 22 and a bottom 24. In accordance with the preferred embodiment of the present invention, a non-hardened stainless steel support tube 26 is positioned within the body 16 of the golf club head 14. The support tube 26 preferably has an outer diameter of approximately 0.25 inches and a wall thickness of 0.020 inches.

The support tube 26 extends from the interior wall 28 of the front face 18 to the interior wall 30 of the rear face 20 of the body 16. The support tube 26 is coupled to the interior wall 28 of the front face 18 at or near the geometric center of the front face 18. The support tube 26 may be attached to the interior wall 28 of the front face 18 and the interior wall 30 of the rear face 20 by any combination of welding, pins, epoxy or other adhesives, friction, threading, or other techniques known to those of ordinary skill in the art, without departing from the spirit of the present invention.

The support tube 26 is shaped and dimensioned to house a gel member 32 which is discussed in greater detail below. As such, the support tube 26 may take a variety of forms without departing from the spirit of the present invention.

The gel member 32 is an elongated member, substantially conforming to the interior shape of the support tube 26. The gel member 32 is preferably wrapped in cellulose 34 and is positioned within the support tube 26 to extend from the interior wall 28 of the front face 18 to the interior wall 30 of the rear face 20. The cellulose 34 aids in the assembly of the support tube 26 and gel member 32, and does not affect the functionality of the gel member 32. As such, the gel member 32 may be positioned within the support member 26 without the cellulose 34 in accordance with the spirit of the present invention.

As with the support tube 26, the gel member 32 includes a longitudinal axis which is preferably oriented in a direction perpendicular to the front face 18 of the body 16. In accordance with a preferred embodiment of the present invention, the gel member 32 is fully confined with the hollow body 16, and is retained therein by the support tube 26, the interior wall 28 of the front face 18 and the interior wall 30 of the rear face 20.

However, and as shown in FIG. 6, an alternate embodiment may include an opening adjacent the point at which the support tube 26' is secured to the interior wall 30' of the rear face 20'. In this way, the interior of the support tube, and the gel member 32', are exposed to the open air and the rear face 20' does not confine the gel member 32 within the club head 14'.

Similar, the gel member need not extend all the way to the rear of the support tube. As such, the orientation of the gel member within the support tube may take a variety of forms without departing from the spirit of the present invention.

By positioning the gel member 32 in direct contact with the interior wall 28 of the front face 18, the transfer of energy from the front face 18 of the golf club head 14 to the golf ball is improved and the energy loss during the transfer from the golf club head 14 to the golf ball is decreased. Specifically, the gel member 32 is positioned at the center of the front face 18 (i.e., the sweet spot), at the location most susceptible to deformation when a golf ball is struck.

During impact with a golf ball, the inertial mass of the gel member 32 is urged in the direction of the front face 18. This creates an impulse which is transferred along the axis of the gel member 32 to the front face 18 where it imposes a resultant force against the interior wall 28 of the front face 18. This resultant force is in opposition to, and counteracts, the club head's tendency to slow and deform during impact. The force instead urges the head forward and supports the front face 18.

The gel member 32 supports only P-waves, the most efficient mode of transmitting energy to the front face 18 of the club head 14. P-waves (or Primary Waves) transfer energy by molecular compression in a direct line away from the source of compression. In contrast, S-waves (or Secondary Waves) transmit energy transverse, or tangentially, to the source of energy and are not desirable for use with the present invention. Gels cannot support shear forces, so they cannot transmit S-waves.

In accordance with the present invention, the impulse energy (P-waves) created by the gel member's inertia is transferred through, and channeled by, the gel member 26 itself to the interior wall 28 of the front face 18. As a result of the above, the transfer of energy from the rear of the gel member 26 to the interior wall 28 of the front face 18 of the club head 14 is purely in the direction "normal to" the plane of the front face 18. The present club head 14 accordingly applies a resultant force directly perpendicular to the front face 18 of the club head 14 and exactly along the line of the planned trajectory of the golf ball. In this way, a more efficient energy transfer system is provided and a struck golf ball achieves greater distance from the point of impact to the point the ball returns to the ground.

Specifically, the gel member 32 is in direct contact with the interior wall 28 of the front face 18 and the physical characteristics of the gel member 32 provide support to the front face 18 of the body 16. That is, gels exhibit low resistance to shear forces, and gels, thereby, have a low resistance to tensile and compressive forces. As a result, gels tend to flow from an area of high force to an area of low force when they are stressed and unrestrained.

These characteristics are employed in the present invention when the front face 18 of the body 14 deflects upon impact with a golf ball. As the front face 18 deflects, the inertial energy and pressure created by the confined gel member 32 subject the interior wall 28 of the front face 18 to a high outwardly directed force. This force is in opposition to the force imposed on the front face 18 of the head body 14 when the golf ball is contacted.

The opposing force imparted by the gel member 32 counteracts the deflection caused by the golf ball, and urges the golf club head 14 to continue in its direction of travel at high speed. By supporting the front face 18 in accordance with the present invention, a more efficient energy transfer is generated, causing the ball to carry much further upon impact.

In accordance with the preferred embodiment, the gel member 32 is a mineral oil gel, for example, a mineral oil combined with a thermoplastic elastomer, for example, KRATON (manufactured by Shell Chemical), prior to heating. While a mineral oil gel is discussed above, a wide variety of materials may be employed within the meaning of the term "gel" as used throughout the body of this specification. Specifically, the use of the term "gel" should be understood to denote any of a variety of viscoelastic substances, including, but not limited to, gels made from silicon, proteins, polymers and/or thermoplastics with oil and/or water filling in the matrix void. Additionally, materials such as viscoelastic thermoplastic elastomers, hydrogels, ultra-low durometer rubber, jellied rubbers, and silicons may be used without departing from the spirit of the present invention.

In addition, while the present invention is specifically designed for metal wood golf clubs, the present invention may be employed in a wide variety of applications and need not be limited to golf clubs.

In accordance with the embodiment disclosed in FIG. 6, the support tube and the gel member may be mounted within the body in the following manner, although other techniques may be readily used without departing from the spirit of the present invention. An approximately 0.25 inch hole is cut in the rear face of the body. The center line of the hole is approximately 0.25 inches below the rear ridge line of the body. The body is positioned such that the access hole is upwardly directed, and the front face of the body is flat on a workbench. Approximately 0.2 cc of epoxy are placed on one end of the support tube and the support tube is installed, epoxy end first into the body. The support tube is then held for ten seconds.

A cellulose wrap is then placed around the gel member, and the cellulose/gel combination is inserted into the support tube. The gel member is slid within the support tube such that it is in direct contact with the interior wall of the front face of the body. The support tube is then centered on the front face and the support tube is set on the interior wall of the front face with a mallet. The epoxy is then permitted to set until cured for approximately one hour.

The club head it is then oriented such that the support tube is vertical and the access opening is downwardly oriented. Approximately 1 cc of epoxy is then injected with a syringe into the support tube slowly, over a period of five to ten seconds, and the club head is then held in this position for approximately five seconds. The club head is then slowly rotated so that the plane of the access hole is horizontal. The syringe is then removed and excess proxy is cleaned. The head is then stabilized and the epoxy is allowed to set until cured for six hours.

Excess stainless-steel projecting from the head is then ground off such that the support tube is flush with the club head and the gel member remains exposed to the open air.

In the event the present gel member is retrofit within an existing club head, the preceding steps are substantially followed and additional steps may be included to complete the job. For example, the area around any grind marks is masked and touch up paint is applied. The masking is then immediately removed. The assembly is then allowed to completely dry and any remaining small voids within the support tube are filled with silicone, or other inert materials. The silicone is smoothed flat with the head surface and excess is cleaned off, resulting in a clean appearance. The club head is then allowed to dry overnight.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A golf club head comprising:

a body including a front face with a rear wall, a rear face, a top and a bottom;

a viscoelastic member confined within a substantially cylindrical support tube positioned within the body and in direct contact with the front face of the body, the viscoelastic member countering force applied to the front face of the body by applying pressure to the front face of the body when a golf ball is struck and transmitting only P-waves in a direct line from the front face and substantially parallel to walls of the substantially cylindrical support tube, and where the force generated by the contact of the golf ball on the front face results in inertial energy and pressure created within the confined viscoelastic member, thereby generating an outwardly directed force against the rear wall of the front face, resulting in a greater energy transmission to the golf ball.

2. A golf club head according to claim 1, wherein the viscoelastic member is an oil gel.

3. A golf club head according to claim 1, further including a support tube extending from the front face of the body, wherein the viscoelastic member is housed within an interior of the support tube.

4. A golf club head according to claim 3, wherein the support tube includes a longitudinal axis which is substantially perpendicular to the front face.

5. A golf club head according to claim 3, wherein the interior of the support tube and the viscoelastic member are exposed though an opening in the rear face of the body.

6. The viscoelastic member of claim 1 comprising a gel member.

7. A golf club, comprising:

a golf club shaft secured to a golf club head, wherein the golf club head includes:

a body including a front face with a rear wall, a rear face, a top and bottom;

a viscoelastic member confined within a substantially cylindrical support tube positioned within the body and in direct contact with the front face of the body, the viscoelastic member countering force applied to the front face of the body by applying force to the front face of the body when a golf ball is struck and transmitting only P-waves in a direct line from the front face and substantially parallel to the walls of the substantially cylindrical support tube, and where the force generated by the contact of the golf ball on the front face results in inertial energy and pressure created within the confined viscoelastic member, thereby generating an outwardly directed force against the rear wall of the front face, resulting in a greater energy transmission to the golf ball.

8. A golf club according to claim 7, wherein the viscoelastic member is an oil gel.

9. A golf club according to claim 7, further including a support tube extending from the front face of the body, wherein the viscoelastic member is housed within an interior of the support tube.

10. A golf club according to claim 9, wherein the support tube includes a longitudinal axis which is substantially perpendicular to the front face.

11. A golf club according to claim 9, wherein the interior of the support tube and the viscoelastic member are exposed though an opening in the rear face of the body.

12. The viscoelastic member of claim 7 comprising a gel member.

* * * * *